United States Patent [19]

Walton et al.

[11] Patent Number: 5,074,112

[45] Date of Patent: Dec. 24, 1991

[54] MICROWAVE DIESEL SCRUBBER ASSEMBLY

[75] Inventors: Frank B. Walton; Peter J. Hayward, both of Pinawa; Frederick P. Adams, Deep River, all of Canada

[73] Assignee: Atomic Energy of Canada Limited, Canada

[21] Appl. No.: 482,882

[22] Filed: Feb. 21, 1990

[51] Int. Cl.[5] ..... F01N 3/02

[52] U.S. Cl. ..... 60/275; 60/303; 60/311

[58] Field of Search ..... 60/274, 275, 303, 311

[56] References Cited

U.S. PATENT DOCUMENTS 4,825,651 5/1989 Puschner ..... 60/275
4,934,141 6/1990 Ollivon ..... 60/275

FOREIGN PATENT DOCUMENTS 221805 5/1987 European Pat. Off. ..... 60/275
126021 7/1984 Japan ..... 60/275
11416 1/1986 Japan ..... 60/275

*Primary Examiner*—Douglas Hart
*Attorney, Agent, or Firm*—Davis, Bujold & Streck

[57] ABSTRACT

A filter assembly for an internal combustion engine comprises, in combination, a housing defining an exhaust gas passage having an inlet end and an outlet end and a cavity intermediate the inlet and outlet ends thereof and in serial fluid communication therewith, the cavity defining an electromagnetically resonant coaxial line waveguide, a filter disposed within the cavity for removing particulate products of combustion from exhaust gases passing through the cavity, and a mechanism for producing axisymmetrically distributed, standing electromagnetic waves within the cavity whereby to couple electromagnetic energy in the waves into lossy material in the cavity to produce heat for incinerating the particulate products of combustion accumulated on the filter.

17 Claims, 3 Drawing Sheets

MICROWAVE DIESEL SCRUBBER ASSEMBLY

FIELD OF THE INVENTION

This invention relates, in general, to an apparatus for separating soot from the exhaust gases of internal combustion engines and, more specifically, to a filter assembly which uses microwave heating to regenerate a filter element employed in the assembly.

BACKGROUND OF THE INVENTION

The incomplete combustion of organic materials, such as petroleum-based fuels, can result in the production of carbon containing particulates or soot. The release of these particulates, along with other combustion products, to the environment can lead to a variety of pollution problems. A number of ceramic based or other high temperature filter devices have been proposed for the purpose of removing soot from combustion gases. Once the filter has collected a certain quantity of soot, the pressure drop across the filter becomes excessive. At that point, the filter element must be either replaced or regenerated by the incineration of the soot in order to allow the filter to be returned to service. One of the more common regenerative methods is the addition of energy to the soot and/or filter to produce heat in order to promote combustion of the soot.

Although the invention described herein can be applied equally well to a variety of soot-filtration and filter-regeneration requirements, a particular application of interest is the elimination of soot generated by compression ignition of diesel engines. Diesel soot does not undergo significant oxidation at temperatures below approximately 400° C. For many diesel engine applications, the average exhaust gas temperature is considerably below this temperature. Under these conditions diesel soot will continue to accumulate in a filter leading to filter blockage and unacceptable engine performance.

Diesel exhaust temperatures can be raised to 500° C. to 700° C. to induce filter regeneration by throttling of the engine. However, this type of regeneration necessitates operator intervention and suspension of normal engine operation for a period of time. For these reasons, throttling has not been widely adopted as a suitable method of filter regeneration. Alternately, external heat sources, such as flames or resistance heating, have been proposed to raise the soot to the required combustion temperature. These methods are either unreliable in initiating soot ignition or produce uneven heating of the filter, leading to either incomplete filter regeneration or destruction of the filter due to localized thermal stresses.

It is known to employ microwave energy to incinerate soot in the exhaust of diesel engines. Erdmannsdorfer et al. United Kingdom Published Application No. 2 080 140, published on Feb. 3, 1982, discloses an apparatus for removing soot from exhaust gases comprising an annular filter element, made of ceramic fibres, mounted on a perforated metal wall and concentrically disposed in a cylindrical resonant microwave cavity. Exhaust gases flow generally axially through the cavity but radially inwardly of the filter element so that particulates tend to accumulate on the outer surface of the filter element. Incineration of the soot is achieved by direct coupling of the soot particles with the microwaves. Since diesel soot is itself a lossy dielectric material, it absorbs energy from the electric component of the electromagnetic field. The electromagnetic field formed in the cavity is not axisymmetrically disposed about the filter element and, therefore, the device does not take full advantage of the electric field component of the microwaves. The patent does not describe any way of extracting heat from the magnetic component of the energy of the microwaves.

Puschner et al. U.S. Pat. No. 4,825,651 issued on May 2, 1989, discloses an apparatus which employs a tubular dielectric insert to concentrate the exhaust flow in an area of a cylindrical resonant cavity of highest energy density of the electromagnetic field produced by a microwave source. The soot is incinerated in the gas phase as it passes through the resonant cavity. Unlike Erdmannsdorfer et al, Puschner does not employ a filter element to trap soot. The patent does not disclose any mechanism which makes use of the energy of the magnetic field component of the microwaves.

Puschner et al. West German Patent No. 35 284 45 discloses direct microwave incineration of the soot augmented by microwave heating of a filter made of lossy dielectric material or a filter in close contact with a lossy dielectric insert. The soot is incinerated by indirect heating, i.e. by heating the lossy dielectric material, which then heats the soot. As mentioned above, diesel soot is itself a lossy dielectric material which absorbs energy from the electric component of the electromagnetic field. Hence, the incorporation of a dielectric material as proposed by West German Patent No. 3,528,445 does not provide a significant advance in the art because a dielectric material, in the form of soot, is already present. Further, like Erdmannsdorfer et al, this patent relies strictly of the electrical content of the microwaves and also fails to provide a mechanism of taking advantage of the magnetic energy content of the microwaves.

In summary, the state of the art relating to diesel filter regeneration using microwave technology is limited to the use of only the electric field component of the microwaves and does not disclose any mechanism for using the magnetic field component of the microwaves. The art has not appreciated the benefits of providing an axisymmetrically distributed, standing electromagnetic waves within the cavity so as to take full advantage of the energy of electric field component, let alone the magnetic field component. As a consequence, the regeneration processes of the current state of the art tend to be inefficient, if not incomplete and unsatisfactory.

SUMMARY OF THE INVENTION

The present invention seeks to provide an exhaust gas filter and regeneration apparatus which makes optimum use of the electromagnetic energy content of microwaves. This is achieved by providing an electromagnetically resonant coaxial line waveguide for receiving a filter and means for producing axisymmetrically distributed, standing electromagnetic waves within the cavity to couple electromagnetic energy in the waves into lossy material in the cavity so as to produce heat for incinerating soot accumulated on the filter.

In accordance with this aspect of the invention, there is provided a filter assembly for an internal combustion engine, the assembly comprising, in combination, a housing defining an exhaust gas passage having an inlet end and an outlet end and a cavity intermediate the inlet and outlet ends thereof and in serial fluid communication therewith, the cavity defining an electromagnetically resonant coaxial line waveguide, filter means disposed within the cavity for removing particulate products of combustion from exhaust gases passing through the cavity, and means for producing axisymmetrically distributed, standing electromagnetic waves within the cavity whereby to couple electromagnetic energy in the waves into lossy material in the cavity to produce heat for incinerating the particulate products of combustion accumulated on the filter means.

The present invention also seeks to provide an exhaust gas filter and regeneration apparatus which not only makes optimum use of the electric field but also of the magnetic field component of microwaves to provide enhanced heating and more uniform heating of the filter. This is achieved by applying a ferrite material to the filter such that the magnetic energy component of the microwaves couples to the ferrite which, in turn, converts that energy to heat.

Resonant microwave cavities have regularly distributed fields which may be used to advantage. A shorted coaxial line resonator has electrical and magnetic field components with sinusoidal and cosinusoidal longitudinal variation, respectively. Both the energy stored in the electromagnetic field and the power absorbed from the field vary as the square of the field. The fields in the resonator are complementary in that the sum of the squares of the sine and cosine functions is a constant. A ferrite-loaded filter placed in the resonant cavity absorbs power from both electric and magnetic fields equally. This achieves longitudinally uniform heating of the filter. Placing the lossy filter material in the electromagnetically resonant cavity couples power from the standing electromagnetic waves into the filter material and lowers the quality factor, Q, of the cavity resonance. The power is coupled into an iris which is dimensioned to achieve "critical coupling" so that all electromagnetic power is coupled into the cavity and then into the lossy filter material. The cavity geometry, and the position and quantity of lossy materials within the cavity influence the Q of the resonance.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
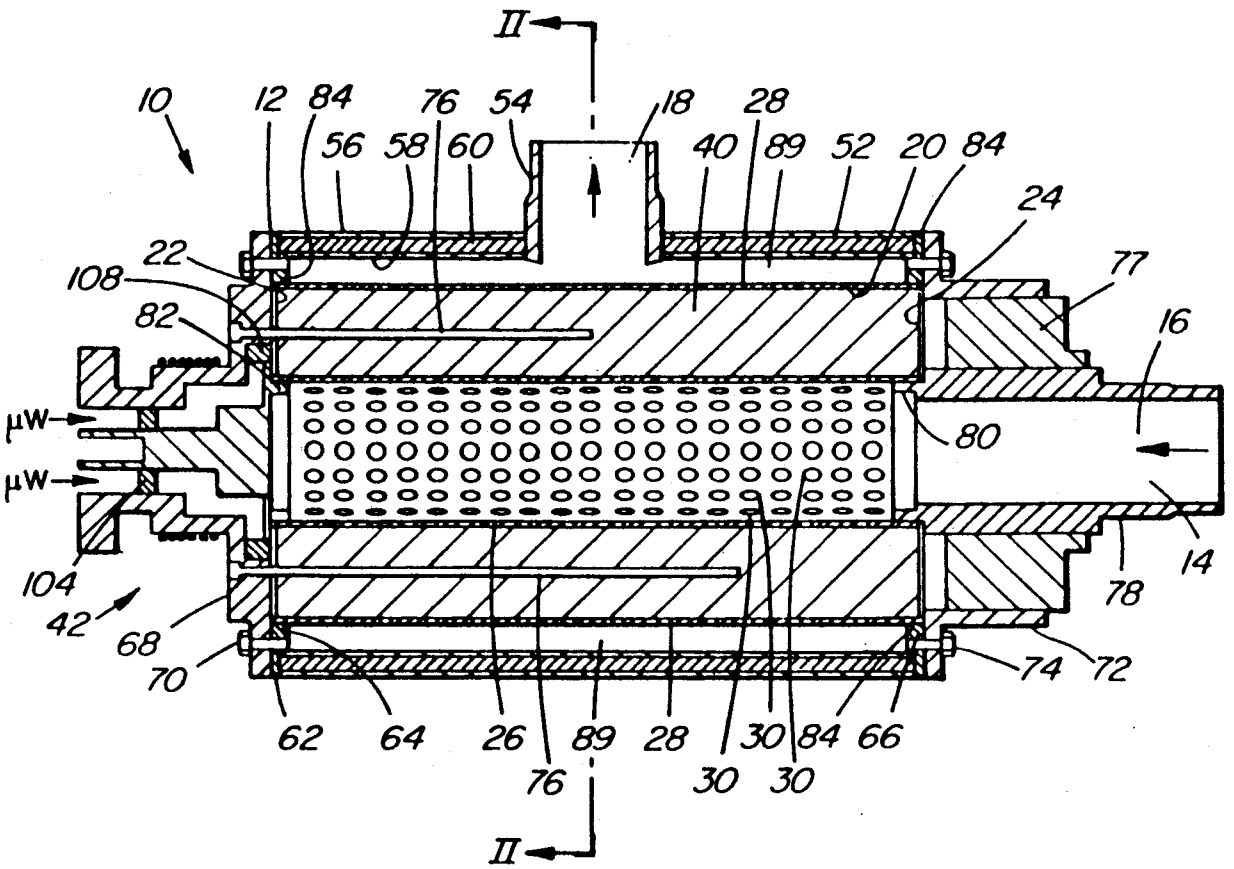
FIG. 1 is a longitudinal cross-sectional view of a filter assembly constructed in accordance with a preferred embodiment of the present invention.

With particular reference to FIG. 1 and by way of overview, the filter assembly 10 of the present invention comprises a housing 12 which defines an exhaust gas passage 14 having an inlet end 16, an outlet end 18 and a electromagnetically resonant coaxial line waveguide cavity 20 intermediate the inlet and outlet ends. The cavity defines a coaxial waveguide having opposed annular end walls 22 and 24 and concentric, electrically conductive, inner and outer cylindrical walls 26 and 28, respectively. Apertures 30 in inner wall 26 provide fluid communication between the cavity and the inlet end of the passage for admitting exhaust gases into the cavity. Apertures 32 in outer wall 28 provide fluid communication between the cavity and the outlet end of the passage for discharging filtered exhaust gases from the cavity into the outlet. It is to be understood at the outset that while exhaust flow is described and illustrated as being radially outward through the cavity, it will become clear from the following description that flow may be radially inward, or a combination of axial and radial flow resulting in a net radial inward or outward flow. Thus, apertures 30 and 32 simply illustrate one means of communicating exhaust gases to a from the cavity. A filter element 40 is disposed within the cavity for removing particulate products of combustion from exhaust gases passing through the cavity. Preferably, the filter is coated with a ferrite susceptor material which absorbs microwave energy coupled into the cavity and produces heat to incinerate trapped particulates therein, as described more fully later. The assembly further includes a microwave source, generally designated by reference numeral 42, for producing axisymmetrically distributed, standing electromagnetic waves within the cavity and coupling the electromagnetic power into the cavity through an iris 108 dimensioned to achieve "critical coupling" whereby all electromagnetic power is coupled into the cavity and thence into the lossy filter material.

The lossy filter material in the electromagnetically resonant cavity couples power from the standing waves into the filter material and lowers the quality factor, Q, of the resonant cavity. The cavity geometry and the quantity and location of the location of lossy materials in the cavity influence the Q of the resonance.

Figure 4:
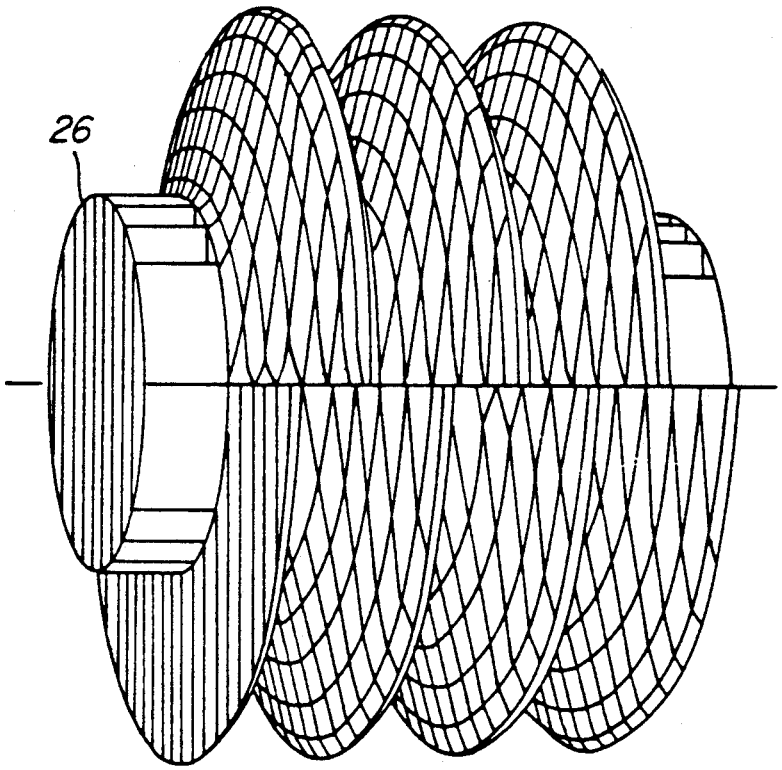
FIG. 4 is a three-dimensional schematic representation of the axial location and relative magnitude of the electric and magnetic fields produced within a coaxial resonant cavity such as that illustrated in FIGS. 1-3.
Figure 5:
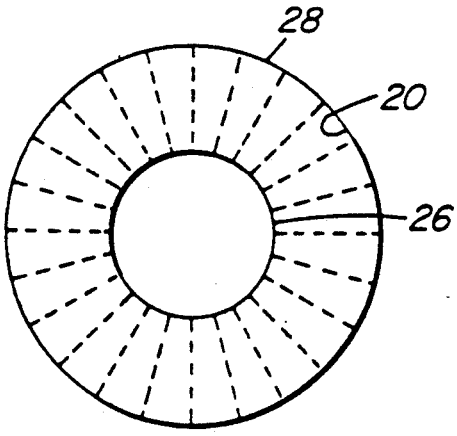
FIG. 5 is a schematic cross-sectional view of a coaxial waveguide illustrating the electric field distribution between the inner and outer conductors.
Figure 6:
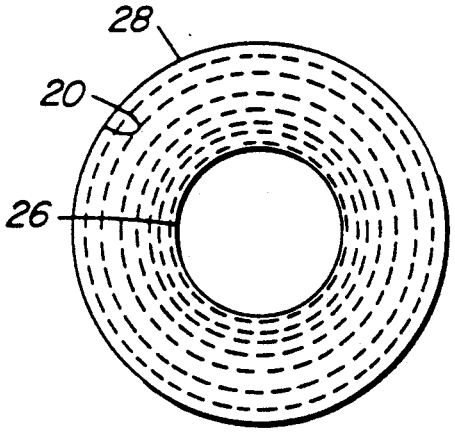
FIG. 6 is a schematic cross-sectional view of a coaxial waveguide, similar to FIG. 5, but illustrating the magnetic field distribution between the inner and outer conductors.

Before describing various soot heating strategies according to the present invention, it is be useful to review the nature of the electric and magnetic field distributions formed within the coaxial waveguide. FIGS. 4-6 illustrate the electric and magnetic field distributions in the shorted coaxial line microwave resonator cavity employed by the present invention. The upper half of the FIG. 4 illustrates the electric field distribution. The lower half illustrates the magnetic field distribution. The fields are contained within an annular cylinder defined by inner and outer electrically conductive walls 26 and 28. The lines used to construct the three-dimensional surface have no quantitative meaning but are merely a means of conveying the three-dimensional aspects of the electric and magnetic field strengths and their axial location relative to the two conductors. It will be seen that the fields have sinusoidal and cosinusoidal longitudinal variation, and thus are axially offset and overlap one another. The fields are complimentary in that the sum of the squares of the sine and cosine functions is a constant. Thus, where the fields overlap, the electric and magnetic induced heating effects are additive for a dual mode ferrite susceptor and summing these effects results in a right cylinder in a three-dimensional description. FIGS. 5 and 6 illustrate the electric and magnetic field potential lines, respectively, associated with coaxial waveguides and/or cavities excited in the basic TEM mode. FIG. 5 shows the electric field lines radiating outwardly from the inner conductor to the outer conductor. The concentrating effect of the coaxial geometry is demonstrated by the field lines being closer near the inner conductor than near the outer conductor. This concentrating effect varies inversely with the radial distance from the axial centre of the assembly. In contrast, the magnetic field potential lines are at right angles to the electric field lines and are concentric about the inner conductor, as shown in FIG. 6. The magnetic field gradient, however, still varies inversely with the radial distance from the axial centre of the assembly. The conversion of RF energy to heat varies as the square of the field strength. Thus, if the radius of the outer conductor is about twice that of the inner conductor, a unit weight of the electromagnetic susceptor material adjacent the inner conductor will convert four times as much RF energy to heat as a unit weight of susceptor material at the outer conductor. This is particularly advantageous in some embodiments because, with exhaust gas flow within the assembly being from the axis outward, more soot will be filtered near the inner conductor than the outer conductor.

Turning now to the heating strategies, there are three factors to consider: the field concentrating effect discussed above, the location, relative density and microwave properties of all materials in the cavity (soot, ferrite, filter, seals, ceramic iris, etc.) and the energy and mass transport distribution within the filter. All of these factors influence the temperature distribution within the filter and determine the thoroughness of filter regeneration, i.e. the completeness of soot combustion, and the magnitude of induced thermal stresses in the filter. The ultimate objective is to maximize regeneration and, when employing a rigid ceramic filter coated with a ferrite material, minimize thermal stresses.

Considering exhaust flow from inside to outside and a filter element which has no or little magnetic susceptance, soot will accumulate adjacent the inner surface of the filter. Such a filter will take advantage of the only the electric field concentration effect described earlier and result in uneven heating of the soot, both axially and radially, by virtue of the periodic nature of the electric field as illustrated in FIG. 4. However, if the filter is coated with a ferrite susceptor, the temperature gradients will be evened out and the thermal stresses will be minimized. With a ferrite susceptor, use is made of the dielectric losses of both the soot and the ferrite in the electric field regions and the magnetic losses of the ferrite in the magnetic field regions during microwave irradiation. The amount, location and composition of the ferrite can be determined and adjusted to provide even axial heating near the inner conductor and a uniform soot ignition front.

On the other hand, if we consider soot loaded into the filter from the outside, caused by outward to inward flow of exhaust gases, a similar procedure may be followed to determine the appropriate ferrite load, amount and location, and composition. There are some advantages to this strategy over the inner to outer flow pattern if the dielectric loss factor for the soot is high relative to that of the ferrite. Recalling that the heating area varies as the inverse of the radius, it can be shown that five times as much soot can be located at the outer circumference than at the inner circumference for the same heating rate. Stated differently, it is easier to even out axial temperature gradients using a ferrite susceptor if the maximum soot concentration is at the outer circumference.

In general, in the two above embodiments, the radial location and concentration of the ferrite load are adjusted to provide a close to uniform axial thermal gradient. In this way, a uniform combustion front starts at either the inner or outer circumference and, thereby, minimizes axial thermal stresses. It follows that radial thermal stresses may be minimized by concentrating the ferrite susceptor on the outside of the filter element.

The preferred ceramic foam filter element employed by the present invention is made according to the teachings of copending Canadian Patent Application Serial No. 615,081 filed on Sept. 29, 1989. Generally, the filter element is formed of a ceramic foam material with the surfaces within the pores thereof being coated with a magnetic material. The preferred ceramic material is a cordierite or a lithium aluminosilicate. The magnetic material is selected from a group consisting of ferromagnetic, antiferromagnetic and ferrimagnetic materials. Preferably, the magnetic material is one or more members of the group consisting of cubic spinel structured ferrites and hexagonal magnetoplumbite-structured ferrites and are materials having a Curie temperature between 400° C. and 700° C.

Figure 2:
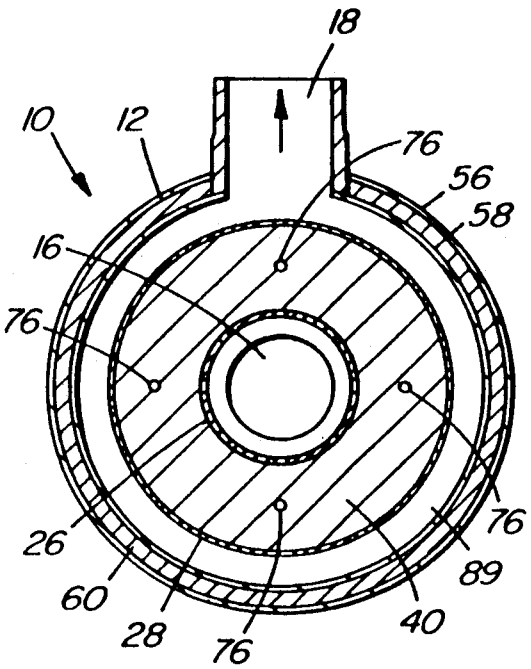
FIG. 2 is a cross-sectional view taken along line 2—2 of FIG. 1.

FIGS. 1 and 2 illustrate a preferred embodiment of the filter assembly of the present invention. Housing 12 includes a tubular outer wall 52 having an exhaust pipe 54 extending radially outwardly therefrom. Wall 52 provides mechanical support and thermal insulation. A preferred construction comprises a pair of concentric, radially spaced cylindrical metallic wall members 56 and 58 with a tube 60 of any suitable ceramic fiber insulation sandwiched therebetween. An austenitic stainless steel is a suitable metal for walls 56 and 58.

The opposed ends of walls 56 and 58 are received in mating grooves 62 formed in the inner surfaces of annular spacers 64 and 66. Spacer 66 is secured to a left end endplate assembly 68 by bolts 70 while spacer 66 is secured to a right hand endplate assembly 72 by bolts 74. Four bolts 76 extending through the housing between the endplate assemblies 68 and 72 serve to hold the endplates in position.

Right hand endplate assembly 72 is formed with an endplate 77 having axially disposed and axially outwardly extending exhaust gas inlet pipe 78 and an axially inwardly extending hub 80 which serves to support one end of inner perforated conductor 26. Left hand endplate plate assembly 68 is formed with a similar axially inwardly extending hub 82 to support the other one end of inner conductor 26. The opposed ends of outer perforated conductor 28 are received in the inner circumferential surfaces 84 of spacers 64 and 66. The spacers 64 and 66, outer wall 52 and outer conductor 28 together define an outlet exhaust gas manifold 89.

Figure 3:
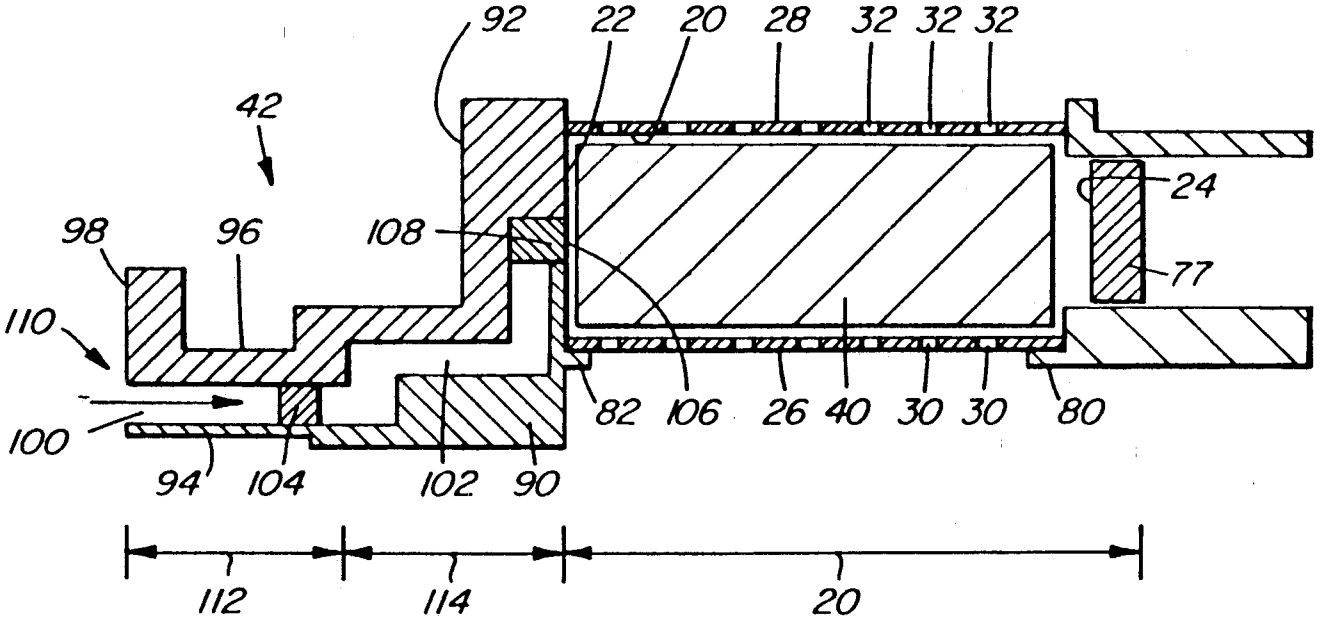
FIG. 3 is an enlarged, schematic view illustrating the basic components of the rf cavity and associated components and omitting, for simplicity, the components whose functions relate strictly to gas flow.

FIG. 3 schematically illustrates the construction of left hand endplate assembly 68. It includes an inner member 90 and a concentric outer member 92 which together define, in part, a left end endwall to form the interior fluid chamber and, in part, microwave waveguides. Inner member 90 is formed with an axially outwardly extending hub portion 94 while member 92 is formed with an axially outwardly extending hub portion 96 terminating in a coupling flange 98. The two members define stepped waveguide sections 100 and 102 and are held in concentric relation by a teflon spacer 104 disposed in waveguide section 100. Waveguide section 102 terminates in a circumferential aperture 106 which opens in the left end of cavity 20 between inner and outer conductors 26 and 28. Aperture 106 receives a low loss ceramic window 108 which doubles as a spacer between members 90 and 92.

Thus, the left hand endplate assembly functions as an axisymmetric waveguide applicator 110 having a 1⅝" 50-ohm coaxial waveguide section 112 and a transition section 114 from section 112 to the low-impedance cavity iris 108. Waveguide section 112 is used to transmit 2.45 GHz microwaves in the principal (TEM) mode. It is to be understood that the operating frequency of the device is not important to the invention and that the actual frequency quoted is only for illustrative purposes. The size of the coaxial line is chosen for maximum power-carrying capacity in a line which supports only the principal mode of propagation at this frequency. The transition section is a single quarter-wave impedance transformer using stepped coaxial sections in a manner well known in the art. The underlying concept of this transformer is the division of the impedance transition into two regions of equal VSWR separated by a quarter of a wavelength. The reflections from these two transitions interfere destructively, cancelling to yield no net reflections. The design was optimized to match the 50-ohm coaxial line to the impedance of the load presented by the coaxial cavity window using finite element analysis methods to solve the electromagnetic wave equations for appropriate boundary and load conditions presented by the transformer, window, filter, cavity, etc. as is well known to those skilled in this art. The transformer section terminates in a lower-impedence line matching the load.

The resonant coaxial cavity end-wall circumferential window is an axisymmetric aperture which couples microwaves into the resonant cavity. The fields in the gap must approximately equal the fields in the cavity for good coupling. Narrowing the gap increases the fields and produces more loss in a low-loss cavity. The optimum aperture dimensions for a particular construction can be determined by the aforementioned finite element analysis methods.

The coaxial cavity resonator may be tuned using an axially adjustable endwall in the right hand endplate assembly. Coaxial-line resonators are produced by short circuiting each end of a section of a coaxial line. A TEM standing-wave rf field may then be supported between the shorted ends, as in the present invention. The field distributions of such cavities are determined by the dimensions of the shorted line. The filter, its ferrite coating and accumulated soot provide the rf load for the system. The ferrite is used to improve heating uniformity and lower the cavity Q.

It will be understood that various modifications and alterations may be made to the above described invention without departing from the spirit of the invention as defined by the appended claims.

The embodiments of the invention in which an exclusive property of privilege is claimed are defined as follows:

1. A filter assembly for an internal combustion engine, said assembly comprising, in combination:

a housing defining an exhaust gas passage having an inlet end and an outlet end and a cavity intermediate said inlet and outlet ends thereof and in serial fluid communication therewith, said cavity defining an electromagnetically resonant coaxial line waveguide;

filter means disposed within said cavity for removing particulate products of combustion from exhaust gases passing through said cavity; and means for producing axisymmetrically distributed, standing electromagnetic waves within said cavity whereby to couple electromagnetic energy in said waves into lossy material in said cavity to product heat for incinerating particulate products or combustion accumulated on said filter means, said means for producing including a concentric, circumferential iris in an end wall of said cavity for coupling microwaves into said cavity.

2. A filter assembly as defined in claim 1, said cavity having opposed annular end walls, a circumferential, axisymmetric aperture disposed in one of said end walls, a ceramic cavity iris disposed within said aperture and being dimensioned to achieve critical coupling whereby substantially all electromagnetic power is coupled into said cavity and into lossy material on or in said filter means.

3. A filter assembly for an internal combustion engine, said assembly comprising, in combination:

a housing defining an exhaust gas passage having an inlet end and an outlet end and a cavity intermediate said inlet and outlet ends thereof and in serial fluid communication therewith, said cavity defining an electromagnetically resonant coaxial line waveguide;

filter means disposed within said cavity for removing particulate products of combustion from exhaust gases passing through said cavity, said filter means being formed of a ceramic foam material having a magnetic material applied thereto, whereby ferrites in said material are operable to absorb power substantially equally from the electric and magnetic field components of said standing electromagnetic waves so as to provide substantially uniform heating longitudinally of said filter means; and means for producing axisymmetrically distributed, standing electromagnetic waves within said cavity whereby to couple electromagnetic energy in said waves inot lossy material in said cavity to product heat for incinerating particulate products of combustion accumulated on said filter means.

4. A filter assembly as defined in claim 3, said magnetic material being selected from the group consisting of ferromagnetic, antiferromagnetic and ferrimagnetic materials.

5. A filter assembly as defined in claim 3, said producing means including a concentric, circumferential iris in an end wall of said cavity for coupling microwaves into said cavity.

6. A filter assembly as defined in claim 3, said cavity having opposed annular end walls, a circumferential, axisymmetric aperture disposed in one of said end walls, a ceramic cavity iris disposed within said aperture and being dimensioned to achieve critical coupling whereby substantially all electromagnetic power is coupled into said cavity and into lossy material on or in said filter means.

7. A filter assembly for an internal combustion engine, said assembly comprising, in combination:

a housing defining an exhaust gas passage having an inlet end and an outlet end and cavity intermediate said inlet and outlet ends thereof and in serial fluid communication therewith, said cavity defining an electromagnetically resonant coaxial line waveguide and having opposed annular end walls and concentric, electrically conductive, inner and outer cylindrical walls;

filter means disposed within said cavity for removing particulate products of combustion from exhaust gases passing through said cavity, said filter means extending lengthwise from one of said end walls to the other of said end walls and from said inner wall to said outer wall, said filter being formed of a ceramic foam material having a magnetic material applied thereto whereby ferrites in said material are operable to absorb power substantially equally from the electric and magnetic field components of standing electromagnetic waves in said cavity so as to provide substantially uniform heating longitudinally of said filter; and means for producing axisymmetrically distributed, standing electromagnetic waves within said cavity whereby to couple electromagnetic energy in said waves into lossy material in said filter to produce heat for incinerating particulate products of combustion accumulated on said filter means, said means for producing including a concentric, circumferential iris in one of said end walls of said cavity for coupling microwaves into said cavity, said iris being dimensioned to achieve critical coupling whereby substantially all electromagnetic power is coupled into said cavity and into lossy material on or in said filter means.

8. A filter assembly as defined in claim 7, said inner and outer walls being perforated to permit exhaust gas flow through said walls.

9. A filter assembly as defined in claim 7, further including a microwave source for producing and delivering said electromagnetic waves to said cavity iris.

10. A filter assembly as defined in claim 9, said microwave source further including means for producing microwaves at a predetermined frequency, a coaxial waveguide section for transmitting microwaves produced by said producing means, and a transition section connecting said window and said waveguide section for transmitting said microwaves in said waveguide section to said iris.

11. A filter assembly as defined in claim 10, said microwave source being operable to transmit microwaves in the principal (TEM) mode.

12. A filter assembly as defined in claim 10, said transition section being a single quarter-wave impedance transformer having stepped coaxial sections and being operable to divide the impedance transition into two transitions of equal VSWR separated by a quarter wavelength so that reflections produced by the two transitions interfere destructively to yield no net reflections.

13. A filter assembly as defined in claim 7, said assembly being arranged such that gas flow through said cavity is radially outwardly.

14. A filter assembly as defined in claim 7, said assembly being arranged such that gas flow through said cavity is radially inwardly.

15. A filter assembly for an internal combustion engine, said assembly comprising, in combination:

a housing defining an exhaust gas passage having an inlet end and an outlet end and a cavity intermediate said inlet and outlet ends thereof and in serial fluid communication therewith, said cavity defining an electromagnetically resonant coaxial line waveguide and having opposed annular end walls and concentric, electrically conductive, inner and outer cylindrical walls, said inner and outer walls being perforated to permit exhaust gas flow therethrough, a concentric circumferential aperture in one of said end walls, and a circumferential ceramic cavity iris disposed said aperture for coupling microwaves into said cavity, said iris being dimensioned to achieve critical coupling whereby substantially all electromagnetic power in said waves is coupled into said cavity and into lossy material therein;

filter means disposed within said cavity for removing particulate products of combustion from exhaust gases passing through said cavity, said filter means extending lengthwise from one of said end walls to the other of said end walls and from said inner wall to said outer wall, said filter being formed of a ceramic foam material having a ferrite material applied thereto whereby ferrites in said material are operable to absorb power substantially equally from the electric and magentic field components of standing electromagnetic waves in said cavity so as to provide substantially uniform longitudinally heating of said filter;

a microwave source for producing microwaves at a predetermined frequency in the principal (TEM) mode;

a coaxial waveguide section connected to said microwave source for transmitting microwaves produced by said producing means; and a transition section connected to said waveguide section for transmitting said microwaves in said waveguide section to said iris for producing within said cavity axisymmetrically distributed, standing electromagnetic waves whereby to couple electromagnetic energy in said waves into lossy material in said filter resulting in heat for incinerating particulate products of combustion accumulated on said filter means, said transition section being a single quarter-wave impedance transformer having stepped coaxial sections and being operable to divide the impedance transition into two transitions of equal VSWR separated by a quarter wavelength so that reflections produced by the two transitions interfere destructively to yield no net reflections.

16. A filter assembly as defined in claim 15, said assembly being arranged such that gas flow through said cavity is radially outwardly.

17. A filter assembly as defined in claim 16, said assembly being arranged such that gas flow through said cavity is radially inwardly.

* * * * *